US008555550B2

(12) United States Patent
Robalo et al.

(10) Patent No.: US 8,555,550 B2
(45) Date of Patent: Oct. 15, 2013

(54) WINDOW REGULATOR AND METHOD OF FABRICATING A WINDOW REGULATOR

(75) Inventors: Jean-Louis Robalo, Varennes Changy (FR); Michel Mounie, Saint Florent le Jeune (FR)

(73) Assignee: Inteva Products France SAS (FR)

( * ) Notice: Subject to any disclaimer, the term of this patent is extended or adjusted under 35 U.S.C. 154(b) by 407 days.

(21) Appl. No.: 12/640,094

(22) Filed: Dec. 17, 2009

(65) Prior Publication Data

US 2010/0154310 A1 Jun. 24, 2010

(30) Foreign Application Priority Data

Dec. 18, 2008 (FR) ..... 08 07118

(51) Int. Cl.
*E05F 15/16* (2006.01)

(52) U.S. Cl.
USPC ..... 49/352; 49/349; 49/348; 49/502

(58) Field of Classification Search
USPC ..... 49/502, 348, 349, 352; 206/325; 242/381.2, 580
See application file for complete search history.

(56) References Cited

U.S. PATENT DOCUMENTS

| | | | | |
|---|---|---|---|---|
| 4,340,191 | A * | 7/1982 | Zavatkay | 242/375.2 |
| 4,442,632 | A * | 4/1984 | Greco et al. | 49/352 |
| 4,480,409 | A * | 11/1984 | Hara | 49/352 |
| 4,577,439 | A * | 3/1986 | Seki | 49/352 |
| 4,644,695 | A * | 2/1987 | Shiraishi et al. | 49/352 |
| 4,753,125 | A * | 6/1988 | Fukumoto et al. | 74/504 |
| 4,829,711 | A * | 5/1989 | Sambor | 49/211 |
| 6,397,524 | B1 * | 6/2002 | Sakaguchi et al. | 49/375 |
| 6,571,515 | B1 * | 6/2003 | Samways et al. | 49/502 |
| 2002/0053168 | A1 * | 5/2002 | Tatsumi et al. | 49/352 |
| 2003/0097795 | A1 * | 5/2003 | Dufour et al. | 49/352 |
| 2005/0016071 | A1 * | 1/2005 | Takeda et al. | 49/352 |
| 2009/0090065 | A1 * | 4/2009 | Kinoshita et al. | 49/352 |

FOREIGN PATENT DOCUMENTS

| | | |
|---|---|---|
| DE | 10216219 | 10/2003 |
| DE | 202005019562 | 4/2007 |
| FR | 2728008 | 6/1996 |
| JP | 2007321345 A * | 12/2007 |

OTHER PUBLICATIONS

Translation of Abstract of JP 2007321345.*
French Search Report for FR0807118 dated Jul. 28, 2009.

* cited by examiner

*Primary Examiner* — Katherine Mitchell
*Assistant Examiner* — Marcus Menezes
(74) *Attorney, Agent, or Firm* — Cantor Colburn LLP

(57) ABSTRACT

A method of fabricating a window regulator includes the step of providing a cable, a window connection on the cable, sheaths for protecting the cable, cable direction-changers, a cable winding drum, a drum support plate, and springs. The method further includes the steps of passing the cable between the direction-changers, inside the springs, inside the sheaths, and around the drum. The method further includes the steps of tensioning a first cable run extending through a first sheath between a first direction-changer and the drum, tensioning the first cable run urging the first sheath against the drum support plate, and compressing a first spring between the first sheath and the support plate. The method further includes the steps of locking the drum against rotation, compressing a second spring between a second sheath and the support plate, and locking the second spring. A window regulator can include the above features.

12 Claims, 2 Drawing Sheets

Fig. 1
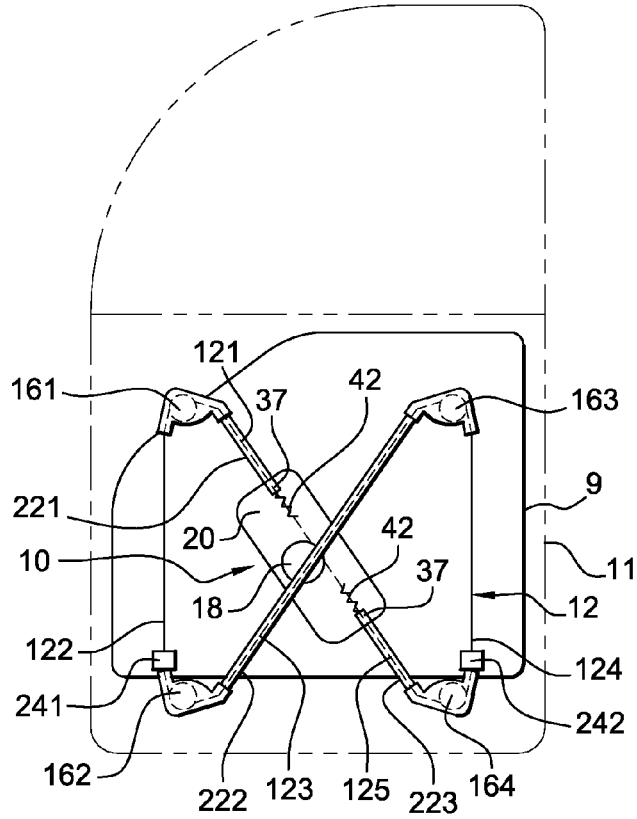
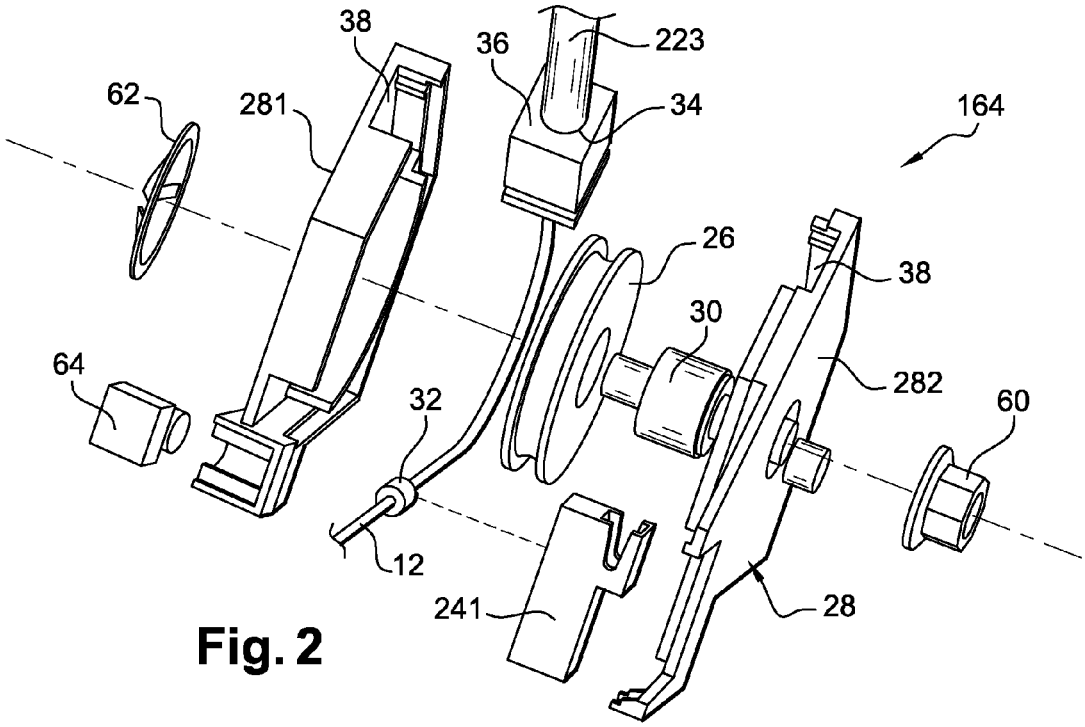
Fig. 2

WINDOW REGULATOR AND METHOD OF FABRICATING A WINDOW REGULATOR

REFERENCE TO RELATED APPLICATION

This application claims priority to French Patent Application No. FR 0807118 filed Dec. 18, 2008.

BACKGROUND OF THE INVENTION

A window regulator and a method of fabricating a window regulator are disclosed.

In automobile construction, the weight of the various components of the vehicle can be a limitation. In particular, window raising and lowering devices, known as window regulators, include window slides or rails for guiding a window driving cursor. The slides or rails can be heavy. There are window regulators without rails, but these must be shipped pre-assembled to a structure to prevent the cables from becoming tangled during transportation.

There is therefore a need for lightweight window regulators that are easily transportable.

SUMMARY OF THE INVENTION

A method of fabricating a window regulator includes the steps of providing a cable, a window connection on the cable, sheaths for protecting the cable, cable direction-changers, a cable winding drum, a drum support plate, and springs. The method further includes the steps of passing the cable between the cable direction-changers, inside the springs, inside the sheaths, and around the drum. The method further includes the steps of tensioning a first cable run extending through a first sheath between a first direction-changer and the drum, tensioning the first cable run urging the first sheath against the drum support plate, and compressing a first spring between the first sheath and the support plate. The method further includes the steps of locking the drum against rotation, compressing a second spring between a second sheath and the support plate, and locking the second spring.

In one embodiment, the step of locking of the drum and of at least one of the springs is affected by a clip that is removable or has a locked/unlocked position. In one embodiment, the window regulator is of the single-lift or double-lift type.

In one embodiment, the method further includes the steps of providing a third direction-changer and a fourth direction-changer connected together by a sheath, and passing the cable between the third direction-changer and the fourth direction-changer through the sheath.

In one embodiment, the method further includes the steps of providing a lug for fixing the sheath connecting the third direction-changer and the fourth direction-changer to the support plate, the fixing lug being connected to the support plate in such a manner that it can be oriented, and orienting the sheath connecting the third direction-changer and the fourth direction-changer until the sheaths are substantially superposed.

In one embodiment, the method further includes the step of clipping at least one cable run having no sheath between two direction-changers to the support plate or to an element fastened to the plate. In one embodiment, a connector is fixed to each end of the sheaths and the support plate, and the direction-changers include a housing for receiving a connector. The sheaths are locked against rotation relative to the direction-changers and/or the support plate by the connectors in the receiving housings.

A method of mounting a window regulator in a bodywork element includes the steps of providing a bodywork element and a window regulator as described above, introducing the window regulator into the bodywork element, fixing direction-changers to the bodywork element, and unlocking the drum and the second spring.

A window regulator includes a cable, sheaths for protecting the cable, a connector fixed to each end of the sheaths, a drum for winding the cable, the drum being locked against rotation, a support plate for the drum, a window connection on the cable, and cable direction-changers. The cable extends from the drum and between the cable direction-changers, and first and second direction-changers are each fastened to the support plate by one of the sheaths. The window regulator further includes a first cable run extending through a first of the sheaths. The first cable run is tensioned between the window connection and the drum and the first sheath compressing a first spring against the support plate, and a second cable run extends through a second of the sheaths. A second spring is locked in compression between the second sheath and the support plate.

In one embodiment, the support plate and the direction-changers include a housing for receiving a connector, the sheaths being locked against rotation relative to the direction-changers and/or the support plate by the connectors in the receiving housings. In one embodiment, the window regulator further includes a third cable run clipped to the support plate or to an element fastened to the support plate. In one embodiment, the window regulator further includes a third direction-changer and a fourth direction-changer connected to each other by a sheath, the cable extending between the third and fourth direction-changers in the sheath, and a fixing lug for the sheath connecting the third direction-changer and the fourth direction-changer. The fixing lug fixes the sheath to the support plate, the sheaths being adapted to be substantially superposed in a shipping position and to be at an angle to each other in a mounted position because the fixing lug connects the sheath to the support plate in an orientable manner.

BRIEF DESCRIPTION OF THE DRAWINGS

Other features and advantages of the invention will become apparent on reading the following detailed description of embodiments of the invention given by way of example only and with reference to the drawings, which show:

FIG. 1 illustrates one example of a window regulator;

FIG. 2 illustrates a direction-changer; and

DETAILED DESCRIPTION OF THE PREFERRED EMBODIMENT

Figure 3:
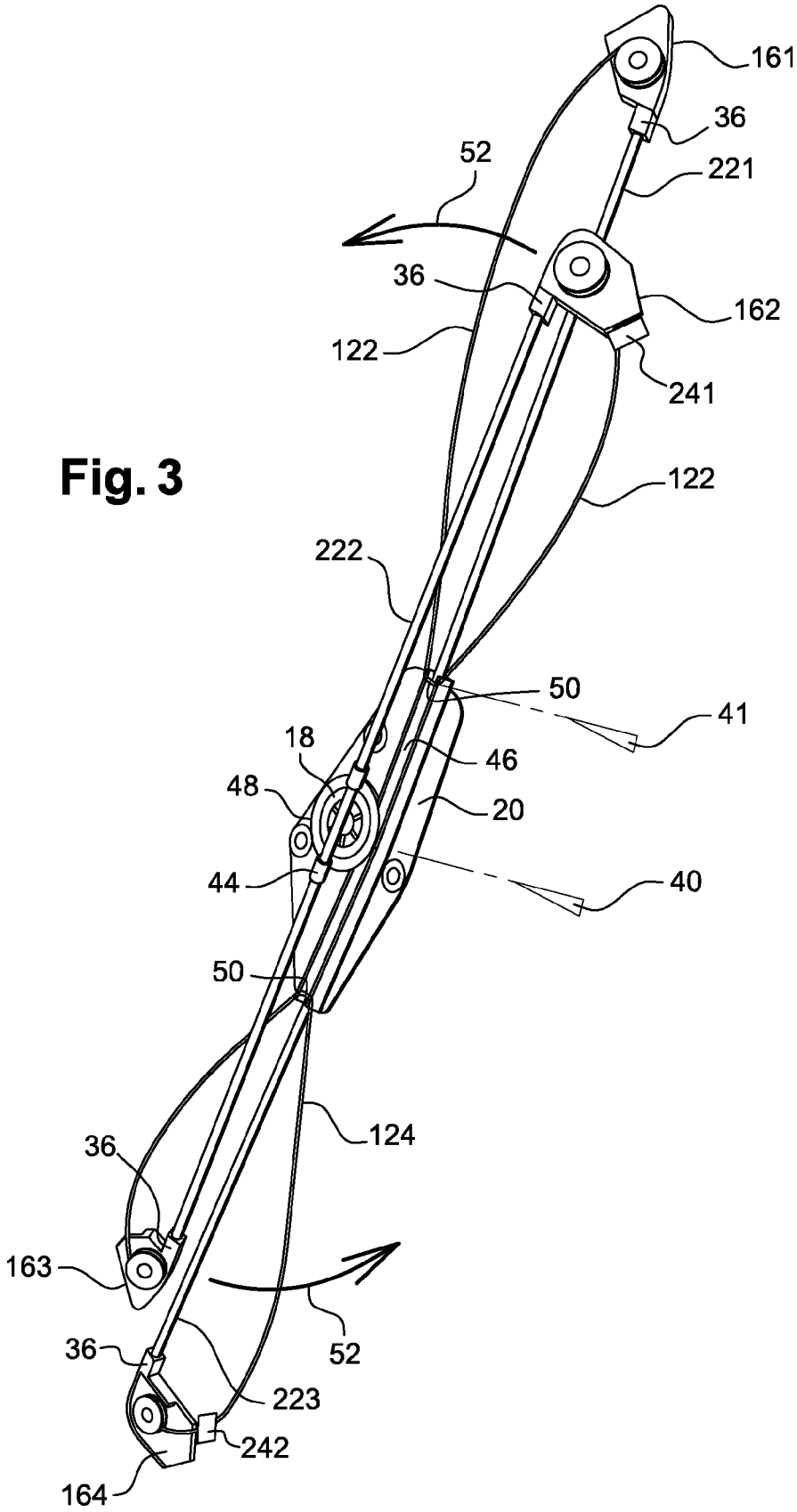
FIG. 3 illustrates a transport or shipping position of the window regulator of FIG. 1.

A method of fabricating a window regulator includes the steps of providing a cable, a cursor on the cable, sheaths protecting the cable, cable direction-changers, a drum for winding the cable, a support plate for the drum, and springs. The cable is passed between the direction-changers, in the springs, in the sheaths and around the drum. One run of cable extending through a first sheath between a first direction-changer and the drum is tensioned, the tensioning of the first cable run urging the first sheath against the drum support plate and compressing a first spring between the first sheath and the support plate. The drum is locked against rotation. A second spring between a second sheath and the support plate is compressed and locked. Alternatively, the first spring is locked and then the drum. The method produces a window regulator in which the various elements are assembled together without using any cursor guide rail. This eliminates the weight of the rail or rails, reducing the weight of the window regulator. The window regulator can be shipped more easily.

FIG. 1 shows an example of a window regulator 10. In FIG. 1, the window regulator 10 is shown in a position of use in a bodywork element 11 of a vehicle. The FIG. 1 window regulator 10 is mounted on a bodywork panel. For example, the window regulator 10 is mounted in a vehicle door box section and moves a window 9.

The window regulator 10 is of the double lift type, for example. That is, this example a window regulator 10 includes two window connections 241 and 242 for driving the window 9. The window regulator 10 includes a cable 12 and angle direction-changers 161, 162, 163, 164. The direction-changers 161, 162, 163 and 164 divert the cable 12 and thus define a cable path. The cable 12 is wound around a drum 18. The drum 18 is used to drive the cable 12 and thus to drive the window connections 241 and 242. The drum 18 is mounted on a support plate 20. The support plate 20 supports the drum 18 when it rotates. The drum 18 can be driven in rotation by a gear-motor that is not shown in the figures. The drum 18 can be clipped to the support plate 20.

The cable 12 includes cable runs 121, 122, 123, 124 and 125. The expression cable run refers to a length of the cable 12 that extends between two direction-changers 161, 162, 163 and 164 or between a direction-changer 161, 162, 163 and 164 and the drum 18 (or the support plate 20).

The cable 12 defines a cable path running from the drum 18 and between the direction-changers 161, 162, 163 and 164. One end of the cable 12 is fixed to the drum 18. The cable 12 passes around the direction-changer 161 and then the direction-changer 162. The cable 12 extends to the direction-changer 163 and the direction-changer 164. The other end of the cable 12 is then fixed again to the drum 18. The cable 12 can be either in one piece or in more than one piece. If the cable 12 is in more than one piece, the window connections 241 and 242 provide relay points for fixing the ends of the cable 12. The window regulator 10 described has an X-shaped cable path. The cable runs 122 and 124 between the direction-changers 161 and 162 and the direction-changers 163 and 164, respectively, move when the drum 18 turns. The window connections 241 and 242 carried by the cable runs 122 and 124, respectively, therefore also move to raise and lower the window 9.

The window regulator 10 also includes sheaths 221, 222 and 223 in which the cable 12 runs. The sheaths 221, 222 and 223 can serve as protection for the cable 12, for example to provide protection against being cut by a cutting tool. A sheath 221 is located between the support plate 20 and the direction-changer 161, a sheath 222 is located between the direction-changers 162 and 163, and a sheath 223 is located between the direction-changer 164 and the support plate 20. The cable runs 121, 123 and 125 can be protected by the sheaths 221, 222 and 223, respectively. The cable runs 122 and 124 are not surrounded by a sheath to facilitate connection of the window 9 to the cables 12 by the window connection 241 and 242, respectively.

The window regulator 10 from FIG. 1 is a rail-less window regulator. Thus, the window regulator 10 does not include rails. The window regulator 10 does not necessitate the use of guide rails for the window connections 241 and 242. The direction-changers 161, 162, 163 and 164 are assembled to the bodywork panel itself, reducing the weight of the window regulator 10.

FIG. 2 shows the direction-changer 164 in detail. Although the direction-changer 164, for example, is shown, the other direction-changers 161, 162 and 163 have the same structure. The direction-changer 164 can include a pulley 26 for diverting the cable 12 to form the cable path. The use of a rotatable pulley 26 facilitates driving the cable 12 along the cable path. The pulley 26 can be mounted in a casing 28 including two shells 281 and 282, for example. The pulley 26 is mounted to rotate in the two shells 281 and 282 about an axis 30. The casing 28 retains the cable 12 on the pulley 26. The two shells 281 and 282 are held together by a nut 60 and a washer 62. The casing 28 also fastens the direction-changer 164 to the cable 12. The gripping of the cable 12 in the casing 28 prevents loss of the direction-changer 164 during transportation of the window regulator 10.

FIG. 2 shows an example of a window connection 241 mounted on the cable 12 by a bead 32. The description also applies to the window connection 242. The bead 32 is molded onto the cable 12, for example. The window connection 241 is fixed to the cable 12 by clipping it to the bead 32, for example. Furthermore, the window regulator 10 can include an attachment member (not shown) for attaching the window connection 241 to the window 9. The attachment member is, for example, fixed to the window connection 241 by a screw. The direction-changer 164 can include a damper 64 mounted on the casing 28. The damper 64 damps the contact of the window connection 241 against the direction-changer 164 at the end of the travel of the window connection 241. The window connection 241 can be fixed to the direction-changer 164 or more particularly to the casing 28. The window connection 241 can be fixed to the direction-changer 164 in a shipping position of the window regulator 10.

FIG. 2 also shows an example of fastening the direction-changer 164 to one end of the sheath 223 (this can apply to the other sheaths). For example, an end 34 of the sheath 223 includes a connector 36. The connector 36 is received in a housing 38 of the direction-changer 164 and in particular of the casing 28. The connector 36 can be inserted between the shells 281 and 282. Each shell 281 and 282 can include part of the housing 38. Once assembled, the shells 281 and 282 retain the connector 36 in the housing 38, which locks the sheath 223 against translation relative to the direction-changer 164. This fastens the direction-changer 164 to the sheath 223. Each sheath 221, 222 and 223 can include a connector 36 at one of its ends, at least. The sheath 222 can include such a connector 36 at each of its ends. The sheath 222 can thus be fastened to the direction-changes 162 and 163 at each of its ends.

The sheaths 221, 222 and 223 can also be indexed to prevent rotation relative to the direction-changers 161, 162, 163 and 164. In other words, the sheaths 221, 222 and 223 can have a particular position relative to the direction-changers 161, 162, 163 and 164. The connectors 36 can prevent relative rotation between the direction-changers 161, 162, 163 and 164 and the respective sheaths 221, 222 and 223. For example, as shown in FIG. 2, the connectors 36 can have a parallelepiped shape. Each of the connectors 36 is received in the housing 38 having a corresponding shape. The casing 28 of the direction-changers 161, 162, 163 and 164 then locks the connector 36 against rotation in the housing 38. The direction-changers 161, 162, 163 and 164 thus have a predetermined position relative to each other and a predefined orientation. This prevents the direction-changers 161, 162, 163 and 164 rotating on themselves, which facilitates mounting the window regulator 10 in the bodywork element 11.

The sheaths 221 and 223 connecting the direction-changers 161 and 164, respectively, to the support plate 20 can also include a connector 37 at the other end. The connector 37 can be received in a corresponding housing of the support plate 20. The connector 37 allows for movement of the sheaths 221 and 223 along the cable 12. However, an abutment on the support plate 20 prevents the sheaths 221 and 223 from being extracted from the support plate 20. The connectors 37 are preferably of the same structure as the connectors 36. In particular, the connectors 36 and 37 are parallelepiped-shaped to orient the sheaths 221 and 223 relative to the direction-changers or the plate.

The connectors 36 and 37 are fastened to the respective sheaths 221, 222 and 223. For example, the connectors 36 and 37 are welded to or molded onto or bonded to the respective end of the respective sheath 221, 222 and 223.

Springs 42 are provided at the ends of the sheaths 221 and 223 provided with the connectors 37. The springs 42 tension the cable 12 when mounting the window regulator 10 in the bodywork element 11 by tensioning the system. The springs 42 provide tensioning even if the cable 12 stretches and the component elements of the window regulator 10 loosen during the service life of the window regulator 10. The springs 42 bear on the support plate 20 and the connectors 37. The springs 42 urge the connectors 37 apart relative to the support plate 20. This tends to lengthen the cable path, which keeps the cable 12 under tension. The springs 42 can be disposed around the connectors 37 and bear on the connectors 37 at a larger diameter end of the connector 37.

FIG. 3 shows the window regulator 10 from FIG. 1 in a transport or shipping position before mounting in a bodywork element. The window regulator 10 is folded. More particularly, FIG. 3 shows the window regulator 10 in the position in which it is mounted in a bodywork element 11 to arrive at what is shown in FIG. 1. The window regulator 10 from FIG. 3 allows fabrication followed by mounting in the bodywork element 11 when the various elements of the window regulator 10 are not fastened together by guide rails. The fabrication method produces a rail-less window regulator 10 that can be mounted directly in a bodywork element 11. This method does not necessitate manufacture of the rail-less window regulator 10 in the position of use. To the contrary, the benefit is to provide a rail-less (or rail-free) window regulator 10 ready to be mounted in the bodywork element 11. Once mounted in the bodywork element 11, the window regulator 10 is deployed and fixed to the bodywork element 11.

The window regulator 10 from FIG. 3 is produced by fabricating the window regulator 10 on a temporary factory support. It temporarily assumes on the temporary support the general shape of the window regulator 10 shown in FIG. 1. The direction-changers 161, 162, 163 and 164 and the support plate 20 are removably fixed to the temporary support.

On the temporary support, the window connections 241 and 242 are at the lowermost position (see FIG. 1) against the direction-changers 162 and 164. This corresponds to a lowered position of the window 9 in the bodywork. The window connections 241 and 242 are removably fixed to the direction-changers 162 and 164.

The direction-changer 161 and the direction-changer 164 are fastened to the support plate 20 by the sheaths 221 and 223, respectively. The cable run 125 in the sheath 223 is tensioned by winding the cable 12 around the drum 18. The window connection 242 is fixed to the direction-changer 164, and the sheath 223 is curved between the direction-changer 164 and the support plate 20 on the temporary support, and winding the cable 12 around the drum 18 tends to reduce the length of cable 12 between the direction-changer 164 and the drum 18. This urges the sheath 223 against the support plate 20 of the drum 18 and compresses the spring 42 between the sheath 223 and the support plate 20. This helps to tension the cable 12 when the window regulator 10 is mounted in position in the bodywork element.

The drum 18 is locked against rotation, which prevents the cable 12 from unwinding during transportation. It also keeps the spring 42 in the compressed position. The drum 18 is locked against rotation by a clip 40, for example. The clip 40 can be removed or unlocked. For example, with the window regulator 10 mounted in the bodywork element, the clip 40 is removed to release the drum 18 to rotate. Locking the drum 18 by a two-position clip is also possible, and the clip does not have to be withdrawn completely to release the drum 18. Locking the drum 18 so that it is released automatically on tightening the fixings of the support plate 20 on the door is possible, or on tightening the fixings of a gear-motor driving the drum 18 (for example, a device of the clip type in the form of a lever activated by a cam). Furthermore, in a solution in which the motor-gearbox driving the window regulator 10 is already mounted on the drum 18, the drum 18 is automatically locked, without any additional clip, as non-reversible gear-motors are used.

The method also includes compressing a second spring 42 between the sheath 221 and the support plate 20. The direction-changer 161 is fastened to the support plate 20 by the sheath 221. The spring 42 between the sheath 221 and the support plate 20 is then locked in compression, for example by a clip 41. This helps to tension the cable 12 when the window regulator 10 is mounted in position in the bodywork element.

In the FIG. 3 example, the window regulator 10 also includes the third direction-changer 162 and the fourth direction-changer 163. The direction-changers 162 and 163 are connected together by the sheath 222. For example, and as described above, the direction-changers 162 and 163 are fastened to the sheath 222 by the connectors 36 at each end of the sheath 222. Furthermore, the direction-changers 162 and 163 are connected to the support plate 20 by a fixing lug 44. In one example, the fixing lug 44 can be oriented relative to the support plate 20. Once the direction-changers 162 and 163 have been detached from the temporary support, the fixing lug 44 orients the sheath 222 so that the sheaths 221, 222 and 223 are substantially superposed in the shipping position. In other words, the sheaths 221 and 223 that are retained by a channel 46 can extend to either side of the support plate 20. Due to the fixing lug 44, the sheath 222 can be turned until the sheaths 221, 222 and 223 form a bundle. The sheath 222 extends along the sheath 221 on one side of the support plate 20 and along the sheath 223 on the other side of the support plate 20. This results in a minimum overall size for transportation. It also facilitates introduction of the window regulator 10 into the bodywork element.

The fixing lug 44 is a part attached to the sheath 222 and to the support plate 20. The fixing lug 44 can include spring clips for attaching the sheath 222 to the fixing lug 44. The fixing lug 44 enables the sheath 222 to slide in order to adjust the direction-changers 162 and 163 to suit the door during mounting. The fixing lug 44 is mounted to rotate relative to the support plate 20. The support plate 20 can include a circular track 48 for angular adjustment of the fixing lug 44. To be more specific, detents in the circular track 48 enable angular adjustment or indexing of the fixing lug 44 relative to the support plate 20. Thus, the sheaths 221, 222 and 223 can be oriented so as to be superposed or, to the contrary, the sheaths 221, 222 and 223 can be oriented to obtain the cable path shown in FIG. 1. For example, the circular track 48 can be concentric with the support plate 20 receiving the drum 18. This facilitates fabrication of the circular track 48. For example, the circular track 48 can be obtained when pressing or molding the support plate 20.

Referring to FIG. 3, once the sheaths 221, 222 and 223 are superposed, the cable runs 122 and 124 with no sheath between the direction-changers are clipped to the support plate 20. The cable run 122 between the direction-changers 161 and 162 is then loosened, the direction-changer 161 being moved toward the direction-changer 162 by orienting the sheath 222. The cable run 122 can therefore be clipped to the support plate 20, for example by a hook 50. The hook 50 can be an additional part, a conformation of the support plate 20, or part of an element fastened to the support plate 20 (for example, a connector 37). This prevents the cable 12 snagging on an external element or the cable 12 becoming tangled during transportation of the window regulator 10. The same goes for the cable run 124 clipped to the support plate 20 by another hook 50.

The window regulator 10 from FIG. 3 is permanently detached from the temporary support. The window regulator 10 can be transported and shipped as a module. The window regulator 10 can then be mounted in the bodywork element 11 from FIG. 1 by a method of mounting that facilitates mounting when access is restricted. For example, the bodywork element 11 can be a vehicle door. The window regulator 10 folded in the mounting and shipping position can be introduced into the door. The door can include a box-section accessible from above or via an interior panel of the door. Once inside the door, the window regulator 10 is unfolded and fixed to the door as shown in FIG. 1. The cable runs 122 and 124 are unclipped from the support plate 20. The sheath 222 is pivoted as shown by the arrows 52 to obtain the X-shaped cable path. All the direction-changers 161, 162, 163 and 164 are fixed to the door. The door can include an interior panel to which the direction-changers 161, 162, 163 and 164 are fixed. The fixing lug 44 can be left permanently on the window regulator 10. The sheath 222 can be partly or completely unfastened from the fixing lug 44 or remain fastened to it.

Mounting the window regulator 10 from FIG. 3 in the bodywork element 11 is facilitated by the connectors 36 and 37. The indexing of the sheaths 221, 222 and 223 ensures that the direction-changers 161, 162, 163 and 164 and the support plate 20 are correctly oriented. The person responsible for mounting the window regulator 10 does not have to concern himself with the orientation of the direction-changers 161, 162, 163 and 164 or the support plate 20. Furthermore, the casings 28 of the direction-changers 161, 162, 163 and 164 orient the cable runs 121, 122, 123, 124 and 125 appropriately. The flexibility of the sheaths 221, 222 and 223, notably the sheaths 221 and 223, enables the shape of the cable path to be adapted to suit the door. In particular, the sheaths 221 and 223 can divert the cable 12 away from a direction strictly in line with the channel 46. The sheaths 221, 222 and 223 are represented diagrammatically in FIG. 1, and it is possible for the sheaths 221 and 223 to have a radius of curvature between the support plate 20 and the respective direction-changer.

Tensioning is effected once the direction-changers 161, 162, 163 and 164 have been fixed to the door. The clip 41 is removed or unlocked. The spring 42 loads the sheath 221, which tensions the cable 12. The drum 18 is released, for example by removing the clip 40. This releases the spring 42, loading the sheath 223. A gear-motor for driving the drum 18 can be coupled to the drum 18. The window connections 241 and 242 are in the lowered position represented in FIG. 1. In the lowered position, the angle between the window 9 and the direction-changers 162 and 164 in the plane YZ (which is a plane perpendicular to that of the window 9) is at a minimum, and the window regulator 10 can therefore be inserted more easily with the window connections 162 and 164 temporarily attached to the lower direction-changers 162 and 164, respectively. The window 9 can be fixed to the window connections 241 and 242, to be more specific to the window attachment members fixed to the window connections 241 and 242. During transportation of the window regulator 10 and its mounting in the bodywork element 11, the members for attaching the window connection 241 and 242 to the window 9 can be fixed to a direction-changer 161, 162, 163 and 164. The window connections 241 and 242 can be designed so that it is released from the attachment feature to the angle direction-changer 161, 162, 163 and 164 during partial or permanent fixing of the window connections 241 and 242 to the window 9. Partial fixing can consist in inserting the window 9 into a groove of the window connections 241 and 242 or inserting a clip in a hole and permanent fixing can consist in clamping the jaws of a groove of the window connections 241 and 242, locking a clip, or any other method known in the cable window regulator art.

The description relates to a window regulator 10 of the double lift type. However, the description is not limited to this type of window regulator. It is applicable to a single-lift window regulator. Such a window regulator includes the support plate 20 supporting the drum 18, two direction-changers and sheaths protecting the cable runs between the direction-changers and the plate. The cable run between the direction-changers is not in a sheath. This cable run supports the window connection. The cable extends from the drum, around the direction-changers and back to the drum. A window is driven by a single window connection. The sheaths are identical to the sheaths 221 and 223. The sheaths are provided with the connectors 36 and 37 described above. The springs 42 at the ends of the sheath at the level of the drum plate also tension the cable. The two direction-changers can be fastened to the support plate 20 via a respective sheath. The cable between one of the direction-changers and the support plate 20 is tensioned as indicated above. Also, the drum and one of the sheaths can be immobilized by the respective clip 40 and 41, as already described. Finally, because of the flexibility of the sheaths, the cable run supporting the window connection can be clipped to the plate by the hook 50. The main difference compared to the window regulator described above is the absence of the third and fourth direction-changers and the sheath connecting them together. Consequently, the fixing lug 44 is not used. However, the rest of the description applies here.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A window regulator, comprising:

a cable;

a first sheath and a second sheath for protecting the cable;

a connector fixed to each end of the first sheath and each end of the second sheath;

a drum for winding the cable, the drum being selectively locked against rotation;

a support plate for supporting the drum;

at least one window connection secured on the cable;

a first cable direction changer and a second cable direction-changer, the cable extending from the drum to the first cable direction changer and the second cable direction-changer and from the first cable direction changer and the second cable direction-changer to the drum, wherein the first cable direction-changer and the second cable direction-changer are only fastened to the support plate by one of the first sheath and the second sheath;

a first cable run of the cable extending through the first sheath, the first cable run being tensioned between the at least one window connection and the drum by a first spring located between the first sheath and the support plate;

a second cable run of the cable extending through the second sheath; and a second spring locked in compression between the second sheath and the support plate, wherein the window regulator does not have any guide rails, a third cable direction changer and a fourth cable direction changer connected to each other by another sheath extending therebetween, a third cable run of the cable extending between the third cable direction-changer and the fourth cable direction changer in the another sheath and a fourth cable run of the cable extending between the third cable direction changer and the second cable direction changer and a fifth cable run of the cable extending between the first cable direction changer and the fourth cable direction changer, wherein the fourth cable run and the fifth cable run are not received within a sheath and wherein the first cable direction changer extends upwardly and away from the support plate in a first direction when the window regulator is in an installed configuration and wherein the second cable direction changer extends downwardly and away from the support plate in a second direction when the window regulator is in an installed configuration, wherein the second direction is opposite to the first direction, wherein the support plate extends upwardly and away from the drum in the first direction and downwardly and away from the drum in the second direction, wherein the second direction is opposite to the first direction, and wherein the support plate further comprises a channel that removably receives the fourth cable run and the fifth cable run therein when the window regulator is in a shipping configuration.

2. The window regulator according to claim 1, wherein the support plate and the first cable direction changer and the second cable direction-changer each include a housing configured for receiving a portion of the connectors secured to each end of the first sheath and the second sheath, wherein the connectors of the first sheath and the second sheath are configured to be locked against rotation relative to at least one of the first cable direction changer and the second cable direction-changer and the support plate by engaging portions of the housings of the first cable direction changer, the second cable direction changer and the support plate.

3. The window regulator according to claim 1, further comprising the third cable run of the cable clipped to the support plate when the window regulator is in a shipping configuration.

4. The window regulator according to claim 1, further comprising: a fixing lug for securing the another sheath to the support plate, wherein the first sheath and the second sheath and the another sheath are adapted to be substantially superposed in a shipping position and at an angle with respect to each other when the another sheath is secured to the support plate.

5. The window regulator according to claim 1, wherein the fourth cable run and the fifth cable run are secured to the support plate by a clip when the window regulator is in a shipping configuration.

6. The window regulator according to claim 5, wherein the at least one window connection is a pair of window connections, one of which is secured to the fourth cable run and the other one of which is secured to the fifth cable run.

7. The window regulator according to claim 1, wherein first cable direction changer and the second cable direction-changer each have a pulley configured to receive a portion of the cable.

8. The window regulator according to claim 7, wherein the first cable direction changer and the second cable direction changer each have a housing for rotatably receiving the pulley therein, wherein each housing is configured to receive at least one connector from the first sheath or the second sheath.

9. The window regulator according to claim 1, wherein the first cable direction changer, the second cable direction changer, the third cable direction changer and the fourth cable direction changer each have a pulley configured to receive a portion of the cable.

10. The window regulator according to claim 9, wherein the first cable direction changer, the second cable direction changer, the third cable direction changer and the fourth cable direction changer each have a housing for rotatably receiving the pulley therein, wherein each housing is configured to receive at least one connector from the first sheath, the second sheath or the another sheath.

11. The window regulator as in claim 1, wherein the support plate is a planar member that extends from opposite sides of the drum and wherein a portion of the first sheath and the second sheath are received within the channel.

12. The window regulator as in claim 1, wherein the support plate is a planar member that extends from opposite sides of the drum and the support plate further comprises a channel, wherein a portion of the first sheath and the second sheath are received within the channel.

* * * * *